US006991549B2

(12) United States Patent
Ballin

(10) Patent No.: US 6,991,549 B2
(45) Date of Patent: Jan. 31, 2006

(54) SOUND PRODUCING PLAY APPARATUS

(75) Inventor: Grant Ballin, New Castle, CO (US)

(73) Assignee: Wonderworks LLC, Aspen, CO (US)

( * ) Notice: Subject to any disclaimer, the term of this patent is extended or adjusted under 35 U.S.C. 154(b) by 0 days.

(21) Appl. No.: 10/626,480

(22) Filed: Jul. 24, 2003

(65) Prior Publication Data

US 2005/0059501 A1 Mar. 17, 2005

(51) Int. Cl.
*A63G 11/00* (2006.01)

(52) U.S. Cl. ..... 472/106; 472/112

(58) Field of Classification Search ..... 472/98, 472/106–115

See application file for complete search history.

(56) References Cited

U.S. PATENT DOCUMENTS 1,550,040 A * 8/1925 Nagy ..... 472/112
2,527,763 A * 10/1950 Probst ..... 472/4
2,784,968 A * 3/1957 Bakula ..... 472/109
4,844,447 A 7/1989 McKnight
5,217,411 A * 6/1993 Spector et al. ..... 472/106
5,421,763 A * 6/1995 Amburgey et al. ..... 446/194
5,660,430 A 8/1997 Clarke
6,093,428 A 7/2000 Hoeting et al.
2001/0029206 A1 10/2001 Henry

FOREIGN PATENT DOCUMENTS

EP 0 758 536 A1 8/1995
EP 1 010 448 A2 12/1999
JP 1 010 448 A3 12/1999
JP 2001-340660 12/2001

* cited by examiner

*Primary Examiner*—Kien Nguyen
(74) *Attorney, Agent, or Firm*—Holme Roberts & Owen LLP

(57) ABSTRACT

An apparatus includes a support member, a moveable member supported by the support member, a user support mechanically associated with the moveable member, and a sound producing mechanism that produces sound as a result of movement of the moveable member between a first position and a second position caused by the user's application of force to the urge the moveable member between the first position and second position. The applications include a play apparatus, wherein the user interacts with the moveable member with the result that the moveable member changes position and a selected sound is thereby produced.

31 Claims, 12 Drawing Sheets

SOUND PRODUCING PLAY APPARATUS

BACKGROUND

1. Field

The present invention relates to devices and equipment having moveable structures operable by the user to generate sounds, and more particularly to devices for play, exercise and recreational activity configured to produce sound when operated by the user.

2. Related Art

Various playground, recreational, and exercise devices and equipment involve the application of force by the user to produce motion. Examples include, but are not limited to, see saws, teeter-totters, swings, and manually operated merry-go-rounds, as well as exercise bicycles and rowing machines. Such equipment is not known to be connected to, or to include, sound-generating structures configured to produce sound when the user operates the equipment.

SUMMARY

Interactive equipment for recreation, play and exercise is configured to produce sound when the user operates the equipment. Such equipment includes children's play apparatuses typically found in schoolyards, parks, and playgrounds and also found sometimes at home. The coordination of sound production with use of the apparatus adds interest and enjoyment and is believed to encourage physical activity.

The apparatus includes a support member, a moveable member, a user support mechanically associated with the moveable member, and a sound producing mechanism that produces sound as a result of movement of the moveable member. The support member is configured for support by either a support surface or a support structure. The moveable member is connected to the support member and is moveable relative to the support member between at least a first and a second position. The user support supports at least one user, and is configured and positioned on the moveable member such that, when the user applies force to the moveable member, the support surface, or the support member, this causes the moveable member to change position between the first position and second position. The sound producing mechanism is connected to the support member, the user support, or the moveable member, and the sound producing mechanism produces audible sounds as a result of the ordinary movement of the moveable member caused by the force applied by the user. The user's interaction with the apparatus thereby produces sound.

Various alternate and equally preferred embodiments of the apparatus are described. One embodiment is an apparatus that includes a moveable see-saw beam, attached to a support member at a pivot point with a pivot mechanism. The see-saw beam moves in a pivoting fashion about the pivot point. The see-saw beam supports at least one user seat structure and, in a preferred configuration, a handle positioned proximate the seat structure. A sound producing mechanism is positioned on the see-saw beam. The sound producing mechanism includes a structure that moves with the see-saw beam and that includes one or more elements that produces sound as the see-saw beam moves from a first position to a second position. In one preferred arrangement, the sound producing mechanism includes a closed container positioned on the see-saw beam, the container having at least one inner chamber that contains at least one moveable object. As the seesaw beam pivots on use, the sound producing mechanism also pivots, such that the moveable object rolls, falls or slides within the chamber. The moveable object is a striking member relative to a struck member within the chamber, such as a sound board, positioned in or made a part of the inner walls of the chamber. As the moveable object changes position within the chamber, it strikes the struck member of the chamber to produce sounds. A plurality of moveable objects can be used. The moveable objects can be solid or hollow, to include but not be limited to marbles, small balls, pebbles, pellets, B–B's, or other similar objects that have sufficient sizing to produce sound as they shift location within the container and contact the struck member. In a further embodiment, the inner chamber also includes elements projecting from the inner surface of the container, and the moveable objects strike the projecting elements as the moveable objects change position in the chamber to produce sound. The projecting elements can be metal pins, chimes, bells, or other similar structures, that produce sound when struck. Optionally, the sound producing mechanism includes an amplifying or resonating device connected with the struck members of chamber, which device intensifies, amplifies or directs the sound produced.

Another embodiment illustrating the same principles is a teeter-totter structure, wherein the moveable member includes a heavy-weight but flexible spring mounted at one end to a support member, and at a second end to a user support, the user support including a user seat and handles, and the user support connected to a sound producing mechanism. In this embodiment, the sound producing mechanism is a container with moveable objects, the moveable objects changing position within the container, to produce sound when the user leans back and forth in the user seat, causing the user support and the spring to tilt back and forth, changing position relative to the support member. Other sound producing mechanisms include bells attached to the user support, and a gong that is struck as the user moves the user support and moveable member.

A further embodiment is an apparatus with a flexible substrate attached at one end to a support base and at a second end to and supporting a user seat. As the user applies force to move the seat up and down, the substrate flexes and bends. The substrate is preferably formed of a thin metal material such as spring steel. The apparatus includes a sound producing mechanism whereby the user can beat or "play" the substrate with mallet-like structures, to produce sound. As the seated user, or another user standing behind the user seat and applying force to move the user seat, moves the user seat, the substrate bends and the sound produced by tapping the substrate with the mallet-like structures changes pitch.

In yet another embodiment, the user support is a platform supported by a flexible spring, connected to a first support member. A pole extends upward from the center of the platform, the pole having a handle which users can hold while standing on the platform. Above the platform a sound producing mechanism is suspended from an arm that is anchored in a second support member. The sound producing mechanism includes a marimba-like structure, which includes a sequence of tines that produce sound when struck by a mallet-like element positioned at the top of the pole. The mallet-like element is brought in contact with the tines of the marimba-like structure when a user tilts or otherwise moves the platform, and so also moves the pole and mallet-like element towards the tines of the marimba-like structure. In one configuration of this embodiment, where the tines are selected to produce the notes of a scale, the user can manipulate the mallet-like element to play a scale, or to play a tune, all while "playing" on the platform.

In yet another embodiment, the support member is a frame and cross bar from which a user support, including a swing seat and hollow tubing connecting the swing seat to the cross bar at a pivoting bearing element, is suspended. The hollow tubing is connected at its top end to an air compressor. When the user applies force to produce a pivoting movement in the swing seat and the tubing, this pivoting movement in turn provides energy to induce the production of a flow of air from the air compressor. The air flow produced by the air compressor passes through valves and an air reservoir that controls the flow rate of the air moving into the hollow tubing towards handle pieces at the bottom end of the tubing. The handle pieces are hollow tubes formed with a configuration resembling organ pipes, including a languid and an aperture proximate the languid, such that when air is directed into the handle pieces, the structure of the handle pieces causes the air in the handle pieces to vibrate and a sound to be generated. Other apertures are formed at selected positions in the handle pieces, and these apertures can be covered by the user's fingers, in the same way a musician covers the holes in a recorder, to produce sounds of varying pitch. These apertures can be located such that, when the apertures are covered and uncovered in a selected way, the resultant sounds produce a scale or a tune or melody. Other configurations can be substituted, including the positioning of one or more reeds in the handle pieces or elsewhere in the tubing, to produce a different sound on movement of the swing mechanism by the user.

A further embodiment includes a spinning chair swing suspended from a frame. The user cranks a hand crank mechanism to wind a concentric spring, and also to rotate a chime ball that produces sound as the user applies energy to the crank mechanism. The user then sits in the chair and releases a brake, which allows the spring to be released. As the spring is released, the chair spins and the chime ball also spins, producing a pleasant chime sound.

DETAILED DESCRIPTION

Figure 1:
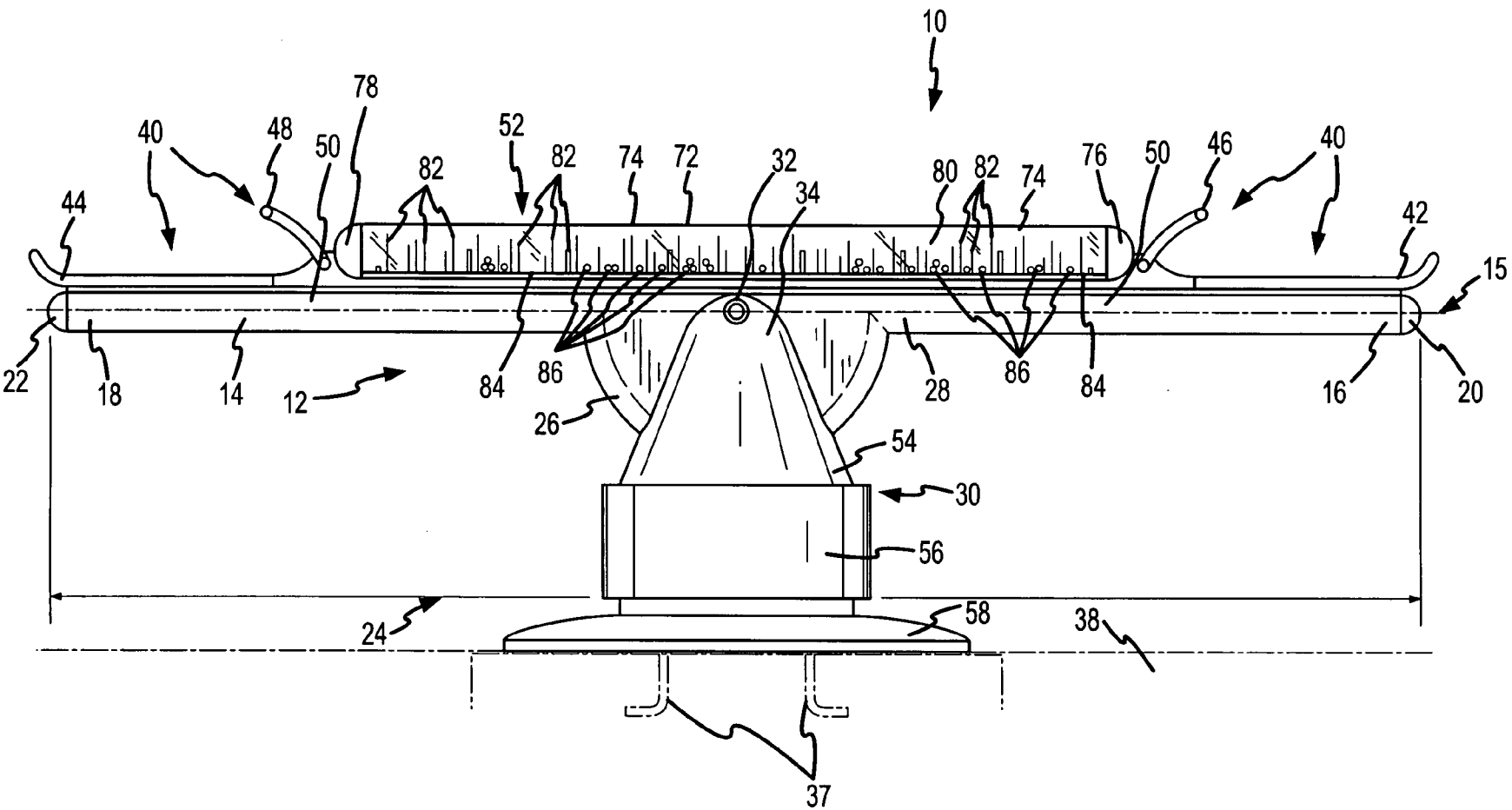
FIG. 1 is a front elevational view of one embodiment of the invention.

FIG. 1 depicts one of several alternate and equally preferred embodiments of the apparatus, a see-saw structure 10. In this embodiment, the moveable member 12 includes a see-saw beam 14. The see-saw beam 14 is here shown as a straight beam extending along axis 15.

The see-saw beam 14 is an elongated tubular structure having two ends 16, 18. In the present embodiment, the see-saw beam 14 is formed of steel tubing with end caps 20, 22, the length 24 of the see-saw beam 14 being approximately 10 feet. Other see-saw beam structures can be envisioned with different shape and sizing. For example, a curved structure can be used. Also, the see-saw beam can be formed of various other materials, such as metallic materials, wood or plastic. The present description is not intended to limit the invention to the size, shape and materials described.

As further depicted in FIG. 1, the moveable member 12 includes an arcuate element 26 connected to the underside 28 of the see-saw beam 14. As discussed in more detail below, the arcuate element 26 is part of a mechanism to dampen the movement of the see-saw beam 14 when the see-saw structure 10 is in operation. The see-saw beam 14 is connected to a support member 30, with a pivot mechanism that includes a pivot pin 32 inserted at the top 34 of the support member 30, through a shaft 36 (not shown) in the see-saw beam 14. The support member 30 is positioned on and connected with metal bolts 37 to a support surface 38, which in the present case is a poured concrete pad. Other support surfaces can be utilized, such as a metal or wooden deck, or an earthen surface. The see-saw structure 10 also includes a user support 40, which includes seat structures 42, 44 and handles 46, 48 positioned on and connected to the top side 50 of the see-saw beam 14. The seat structures 42, 44 are formed of molded plastic, and the handles 46, 48 are stainless steel, although other materials can be utilized as will be appreciated by those familiar with the field. In an alternate embodiment, the handles 46, 48 can be omitted.

As also depicted in FIG. 1, the see-saw structure 10 includes a sound producing mechanism 52, connected to the top side 50 of the see-saw beam 14. When the see-saw structure 10 is in use, a user is seated on each of the two seat structures 42, 44. The users apply force by pushing off from the support surface 38 with their feet, or leaning back and forth, causing the see-saw beam 14 to pivot in a familiar up and down movement. The movement of the see-saw beam 14, in turn, activates the sound producing mechanism 52, to produce sound audible to the users.

Figure 2:
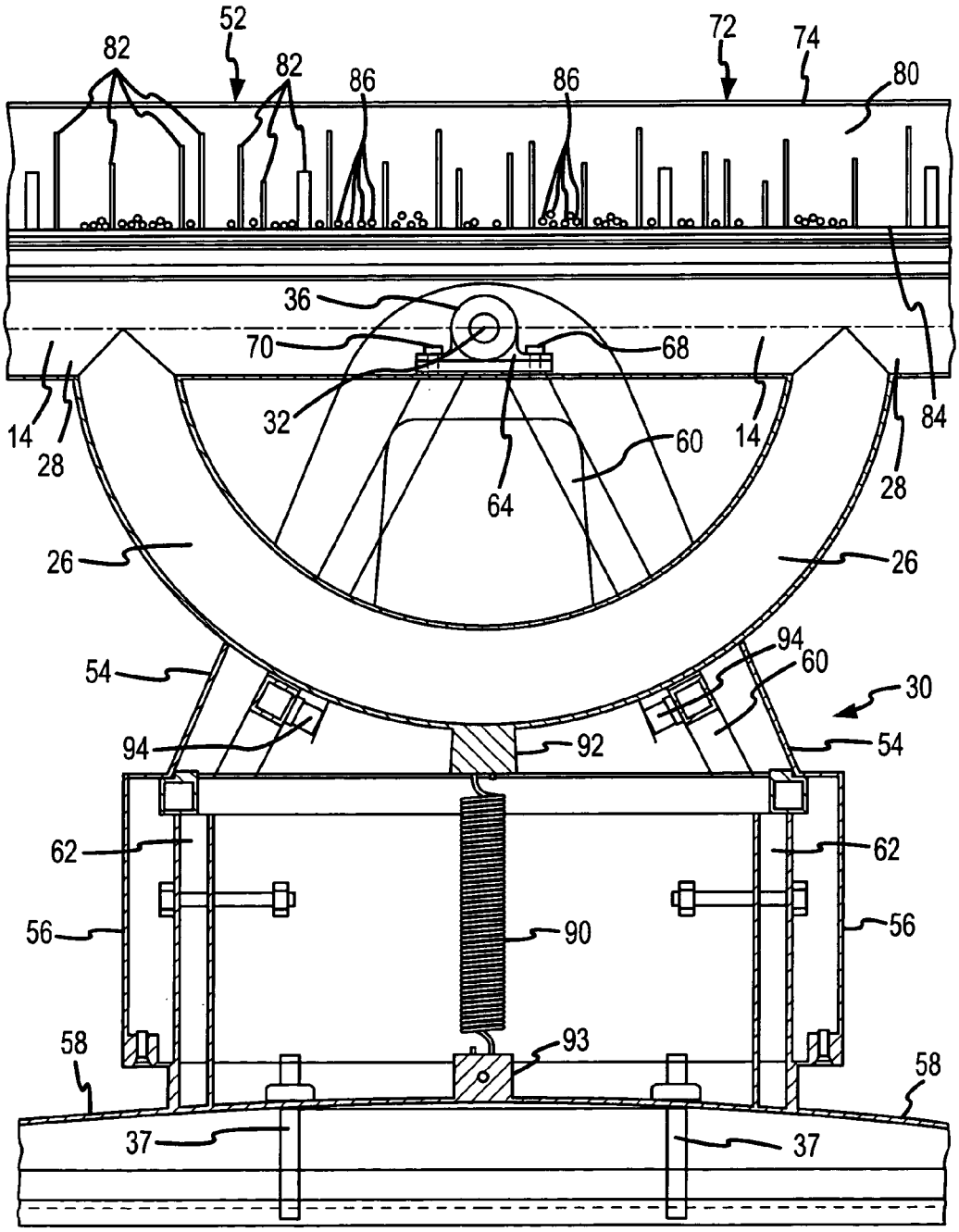
FIG. 2 is a partial front cross-sectional view of the support member of the embodiment of FIG. 1.

As depicted in FIG. 1, the external features of the support member 30 include a support member cone 54 and a liftable access cowl 56, which act as external coverings, and a convex base 58, bolted to the support surface 38. FIG. 2 provides a front cross-sectional view of the internal workings of the support member 30. The support member 30 includes a pivot support frame 60. The pivot support frame 60 supports a pillow block 64 which in turn supports a removable pivot pin 32, the pivot pin 32 being inserted through a shaft 36 in the see-saw beam 14. In the present embodiment, where the two ends 16, 18 of the see-saw beam 14 have approximately the same size, configuration and weight, the shaft 36 is located at a point equidistant between the end caps 20, 22 of the see-saw beam 14. The pillow block 64 is bolted to the pivot support frame 60 by two pairs of mounting bolts 68, 70. The pivot pin 32 acts as a fulcrum point, and the see-saw beam 14 attains a balanced resting position, horizontal to the ground, when not in use. The pivot support frame 60 and pillow block 64 are covered by the steel support base cone 54. Security cones (not shown) cover each exposed end of the pivot pin 32. The pivot support frame 60 is supported by the base support frame 62, and the base support frame 62 is enclosed in the steel liftable access cowl 56, the base support frame 62 being connected to the convex base 58.

Figure 3:
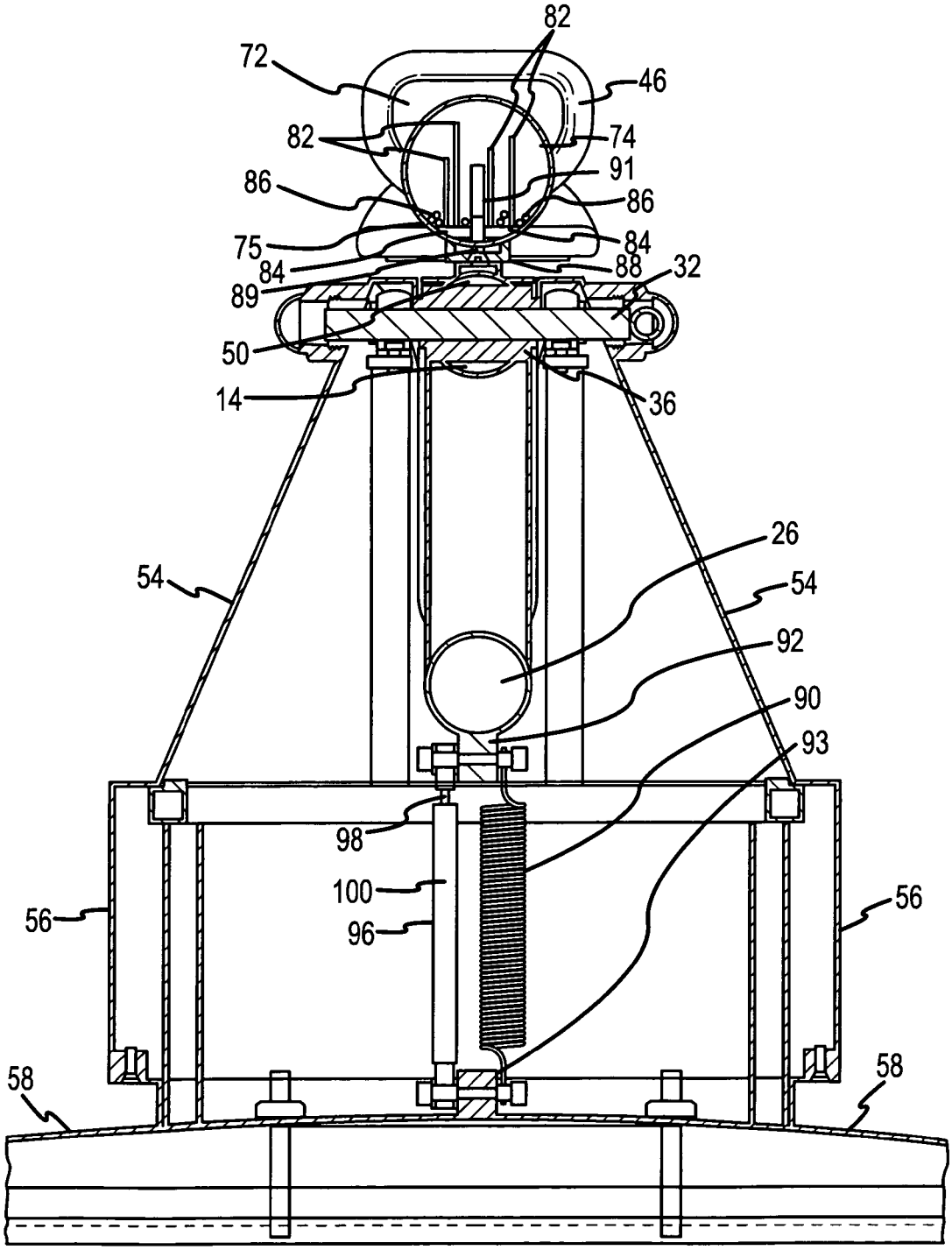
FIG. 3 is a side cross-sectional view of the support member of the embodiment of FIG. 1.
Figure 4:
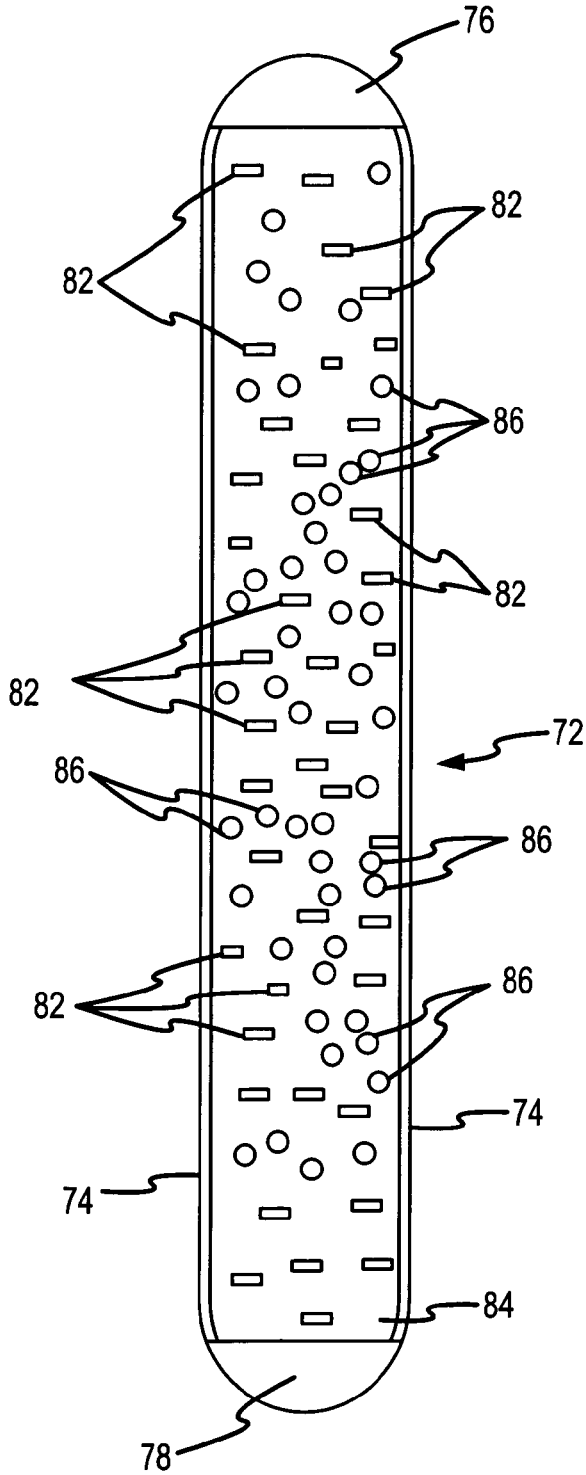
FIG. 4 is a top view of the sound producing mechanism of the embodiment of FIG. 1.

Referring to FIGS. 1, 2 and 3, the sound producing mechanism 52 includes a container, the container being a closed cylindrical tube 72 attached to the top side 50 of the see-saw beam 14. The side walls 74 of the tube 72 are formed of transparent plastic material, such as Lexan®, and the tube 72 includes end caps 76, 78 to close the ends of the tube 72. In the present embodiment, the tube 72 is 6 feet in length, and it is centered above the pivot pin 32, and positioned between the two handles 46, 48. The side walls 74 of the tube 72 and the end caps 76, 78 form an interior air-filled chamber 80 within the tube 72. A plurality of projecting elements 82 are connected to a sound board 84 positioned in the base side wall 75 of the tube 72. The projecting elements 82 extend into the chamber 80. The projecting elements 82 can alternately be positioned on the side walls 74 or in a structure (not shown) within the chamber 80. The projecting elements 82 are metal sound pins of varying heights and diameters. As can be appreciated, in other embodiments, other sound sources can be substituted for sound pins, such as chimes, bells, tuning forks, marimba or xylophone bars, wooden tubes, rattles, and the like. The sound producing mechanism 52 constitutes a closed container and includes also a plurality of moveable objects 86 free to move about loosely within the chamber 80. In the present embodiment, these moveable objects 86 are small balls, resembling marbles, of varying diameter, formed of a ceramic material. When one end 16 of the see-saw beam 14 is tilted or raised upward from the first horizontal resting position to a second position raised vertically upward from the first position, causing the other end 18 to drop downward, the corresponding end of the tube 72 is also raised, and the moveable objects 86 fall, roll or slide through the tube 72 towards the opposite end of the tube 72, which (like the end 18 of the see-saw beam 14) is tilted downward. All or a portion of the moveable objects 86 strike one or more projecting elements 82, producing a sound audible to the user. The moveable objects 86 operate as striking members, which strike the projecting elements 82, the struck members, and the contact of the striking members with the stuck members produces a percussive sound. It should be noted that the moveable objects 86 can also strike the side walls 74, sound board 84, and end caps 76, 78 as they change position and move through the tube 72, and that the composition of these elements can be varied to produce desired or selected sounds. The moveable objects 86 can be of varying size and diameter and can be formed of any of various materials, such as metal, plastic, wood or glass, as will be appreciated. They can be solid or hollow. Additionally, in other embodiments, the moveable objects 86 can be replaced by other objects such as pebbles, plant seeds, pellets, small B—B like objects, and the like. Altering the number, size, shape and composition of these objects can alter the sound produced. Additionally, altering the composition, size and position of the projecting elements 82, and locating them in a selected pattern or configuration within the chamber 80, can produce a different sound. FIG. 4 is a top view of one configuration of the sound producing mechanism 52 of FIG. 1 in the resting, horizontal position, depicting the tube 72, with side walls 74, sound board 84, projecting elements 82, end caps 76, 78 and movable objects 86.

As will be appreciated, the sound producing mechanism 52 of the present embodiment operates in a manner similar to a rain stick. For example, if the users are two children seated on opposite ends of the see-saw beam 14, as the users apply force to the see-saw beam 14, by pushing off with their feet, or leaning backwards and forwards, causing the see-saw beam 14 to pivot up and down, the tube 72 also moves, in parallel with the movement of the see-saw beam 14. As the tube 72 tilts, the moveable objects 86 change position within the chamber 80 of the tube moving from the raised end to the lowered end by force of gravity, striking some or all of the projecting elements 82, the side walls 74, and end caps 76, 78. When a large quantity of small moveable objects such as metal B–B's is used, along with a large quantity of sound pins, the sound produced by the change in position of the objects resembles falling rain, or beating waves, and the rhythm of the sounds is coordinated with the speed with which the see-saw beam 14 pivots. It should be noted that an alternate embodiment is contemplated, wherein there are no projecting elements 82 or sound board 84 to support the projecting elements 82, and the moveable objects 86 contained in the chamber 80 produce sound by striking the side walls 74 and end caps 76, 78.

In a further embodiment, the sound producing mechanism 52 also includes a resonator 88 which, in this embodiment, is positioned beneath the tube 72 and above the see-saw beam 14. The projecting elements 82 are anchored in the sound board 84, the resonator 88 being a channel, open at both ends, formed of aluminum and fitted to the bottom outer surface of the tube 72, forming with the outer surface of the sound tube 72 a hollow open-ended tube. The resonator 88 intensifies and prolongs the sound produced by the moveable objects 86 as they strike the projecting elements 82 and other internal surfaces of the tube 72. In the present embodiment, the resonator 88 is connected by one or more bolts 89 that extend through the resonator 88, and the lower side wall 75 of the tube 72, through the sound board 84, and into one or more sound board mounting posts 91. Other sound resonator and sound amplifying and directing configurations can be contemplated, including sound boxes and megaphone bells and cones, and the present description is not intended to limit the invention to the embodiment specifically described herein.

In a further embodiment, the apparatus also includes a damping means, to restrict the extremes of motion of the see-saw beam 14, so slowing the motion of the moveable objects 86 within the chamber 80 of the tube 72, and thereby extending the duration of and enhancing the sound produced by the objects 86 as they move through the chamber 80.

Referring to FIGS. 2 and 3, the damping means includes an extension spring 90 and a shock absorber 96 positioned in parallel with the extension spring 90, both connected to the arcuate element 26 attached to the underside 28 of the see-saw beam 14. The arcuate element 26 extends beneath the see-saw beam 14, and is partially contained within the support base cone 54. The extension spring 90 is attached at opposite ends to upper and lower mounting blocks 92, 93 and is thereby extended between the bottom of the arcuate element 26 and the convex base 58. Rubber cushioning pads 94 are connected to the internal pivot support frame 60. FIG. 2 depicts the position of the arcuate element 26, extension spring 90, and upper and lower mounting blocks 92, 93, when the see-saw beam 14 is in its horizontal or resting position. As the see-saw beam 14 pivots, the arcuate element 26 also pivots, around an axis which runs perpendicular to the see-saw beam 14 at the pivot pin 32, such that the upper mounting block 92 moves upward in an arc, pulling the extension spring 90 upwards, and towards the support base cone 54 and away from the convex base 58. The rubber cushioning pads 94 limit the range of movement of the upper mounting block 92, and in turn the movement of the arcuate element 26 and see-saw beam 14, and also protect the surface of the internal pivot support frame 60.

FIG. 3 provides a side cross-sectional view of the see-saw structure 10, also in the resting position, displaying the shock absorber 96, connected in parallel with the extension spring 90 to the upper mounting block 92 and lower mounting block 93. As the extension spring 90 is extended with the movement of the arcuate element 26 away from its resting position, the piston rod 98 of the shock absorber 96 is withdrawn from the shock absorber cylinder 100. When the arcuate element 26 pivots in a reverse direction, such that the upper mounting block 92 returns to its resting or low point, the extension spring 90 retracts, and the piston rod 98 is forced back into the shock absorber cylinder 100, the shock absorber 96 resisting the movement of the piston rod 98. As can be appreciated, the shock absorber 96 and extension spring 90 exert a damping force, slowing the speed and resisting the extremes of movement of the see-saw beam 14. Varying the characteristics of the extension spring 90 and shock absorber 96 alters the range of motion and speed by which the see-saw beam 14 pivots thereby also altering the sound produced by the sound-producing mechanism 52. In the present embodiment, a gas shock absorber is used, although other shock absorber structures can be utilized including oil and spring-based systems.

As will be appreciated, the apparatus can be embodied in other configurations with alternate moveable member, user support and support member structures and alternate sound-producing mechanisms, and the present description is not intended to limit the invention to the structures and sound producing mechanisms described above.

Figure 5:
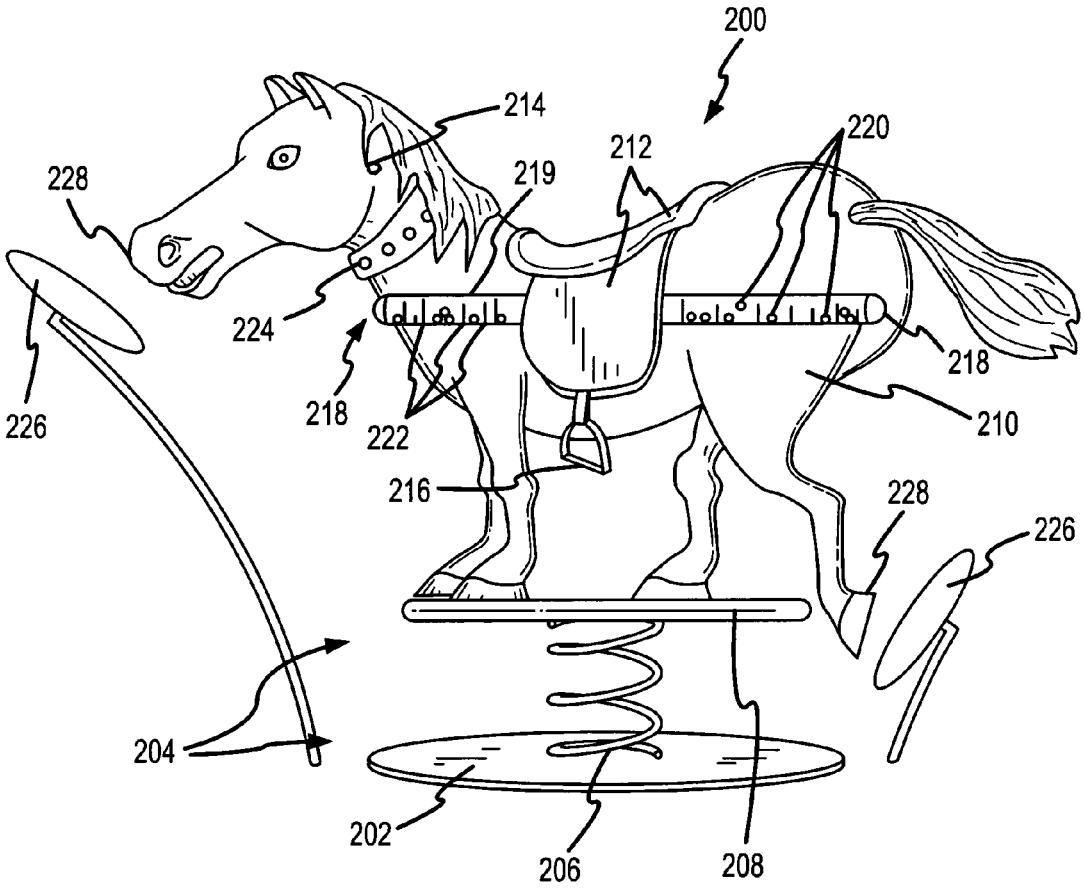
FIG. 5 is a side view of another embodiment of the invention.

For example, many playgrounds include teeter totter structures, in which a single heavy-weight but flexible spring is anchored at a first end in a support member positioned in the ground. The spring is then connected at a second end to a user support, upon which the user is seated. As the user leans back and forth, or sideways, changing his center of gravity, the user support moves from a first position to a second position, with the top end of the spring also flexing and bending back and forth, relative to the support member. In the present embodiment, a sound producing mechanism is connected to the user support, and the user's leaning motion causes the sound producing mechanism to produce sound. FIG. 5 illustrates a version of this embodiment, wherein the moveable member includes a spring, and the user support includes a decorative structure in the shape of a horse, having a seat, which can accommodate one or two users. As depicted in FIG. 5, the teeter totter structure 200 includes a support member 202, which is a concrete or metal anchoring block positioned in the ground; a moveable member 204, which includes a spring 206 and a support platform 208; a user support 210, in the decorative shape of a horse, fitted with a user seat 212, handle 214, and stirrups 216 for the user's feet; and a sound producing mechanism 218 connected to the user support 210. It should be noted that in a further alternate embodiment, the user support 210 is connected directly to the spring 206, without the support platform 208. In the embodiment shown in FIG. 5, the sound producing mechanism 218 is similar to that of the embodiment in FIGS. 1–4, and constitutes a container 219 with one or more inner chambers that includes moveable objects 220 and projecting elements 222. As will be appreciated, a single user seated on the user seat 212 applies force by leaning backwards and forwards, causing the user seat 212, the user support 210, and moveable member 204 to change position relative to the support member 202. As the user support 210 and moveable member 204 are moved back and forth by the user, the sound producing mechanism 218 also changes position relative to the support member 202, and the moveable objects 220 in the container 219 change position, striking the projecting elements 222 and producing sound audible to the user. In further embodiments, the sound producing mechanism can include, in the alternative or as additional sound producing features, bells 224 connected to the user support 210 that ring or jingle as the user support 210 moves from one position to another with the user's leaning movements while seated in the user seat 212, and gongs 226 that are struck by striking elements 228 of the user support 210 also as the user moves back and forth while seated in the user seat 212. As will be appreciated, these bell and gong elements can be configured to produce a tune, a melody, a chord, a harmony or other arrangement of tones. As will be appreciated, the user's leaning movements, which operate the teeter totter structure, also activate the sound producing mechanism to produce a pleasant sound that is coordinated with the user's movement.

Figure 6:
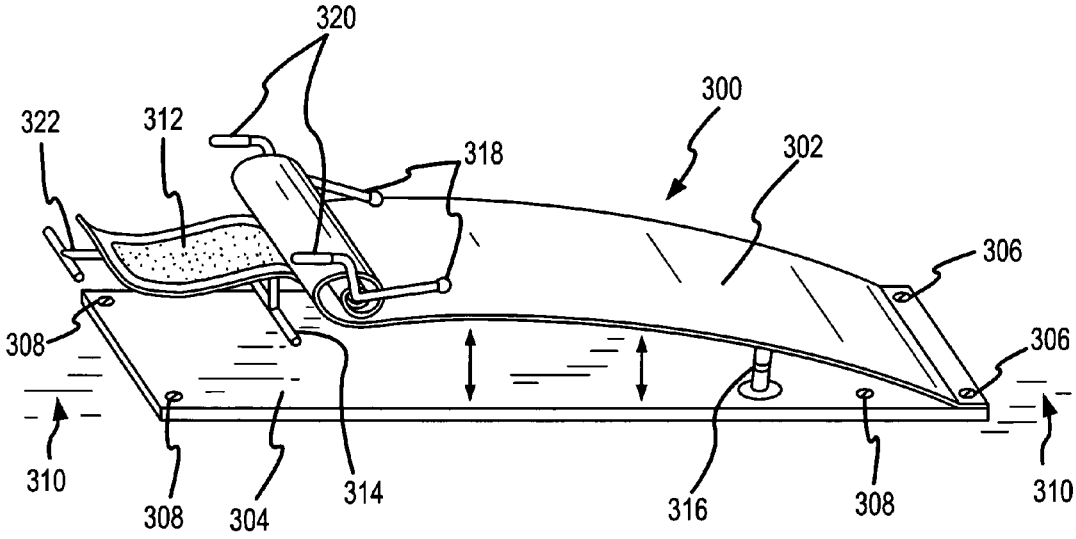
FIG. 6 is a side view of a further embodiment of the invention.

Another embodiment 300 is depicted in FIG. 6, which includes a flexible substrate 302, connected to a support base 304 by connecting bolts 306. The support base 304 is anchored by bolts 308 to the support surface 310. A user seat 312 is connected to the substrate 302. A user is seated in the seat 312 and the user's feet optionally rest on a foot rest 314. The user can bounce up and down vertically in the seat 312, causing the substrate 302 to move and bend in an up and down fashion. In the present embodiment, the substrate 302 is formed from a thin metal material such as spring steel, although other flexible materials can be utilized, such as brass, or certain durable wood materials. A shock absorber 316 is anchored in the support base 304 and is connected to support and dampen the movement of the substrate 302. Additionally, there are mallet-like structures 318 connected to the substrate 302, which the user can manipulate with handles 320 to strike, pound or tap the substrate 302, to produce a sound. The user can hold the handles 320 while moving the substrate 302, and can, at the same time, tap the mallet-like structures 318 on the substrate 302. The structure 300 also can optionally include a handle 322, located on the back of the seat 312, which a second individual can use to apply force to the seat 312 causing it to change position. In this way, another individual, such as a parent or friend, can increase the motion of the seat 312, and the substrate 302, providing a more exciting "ride" for the user seated in the seat 312 as the seat 312 moves. Also, as the substrate 302 bends and flexes, the sounds produced by tapping the mallet-like structures 318 on the substrate 302 change in pitch, producing a varied and enhanced sound.

In the embodiment of FIG. 6, the substrate 302 constitutes the moveable member to which the user support, the seat 312, foot rest 314, and handles 320, are connected. In this embodiment, the sound producing mechanism includes the substrate 302, the mallet-like structures 318, handles 320, and handle 322. The support base 304, connecting bolts 306 and 308, and shock absorber 316 together constitute the support member. In this embodiment, the moveable member, the substrate, is also an element of the sound-producing mechanism.

Figure 7:
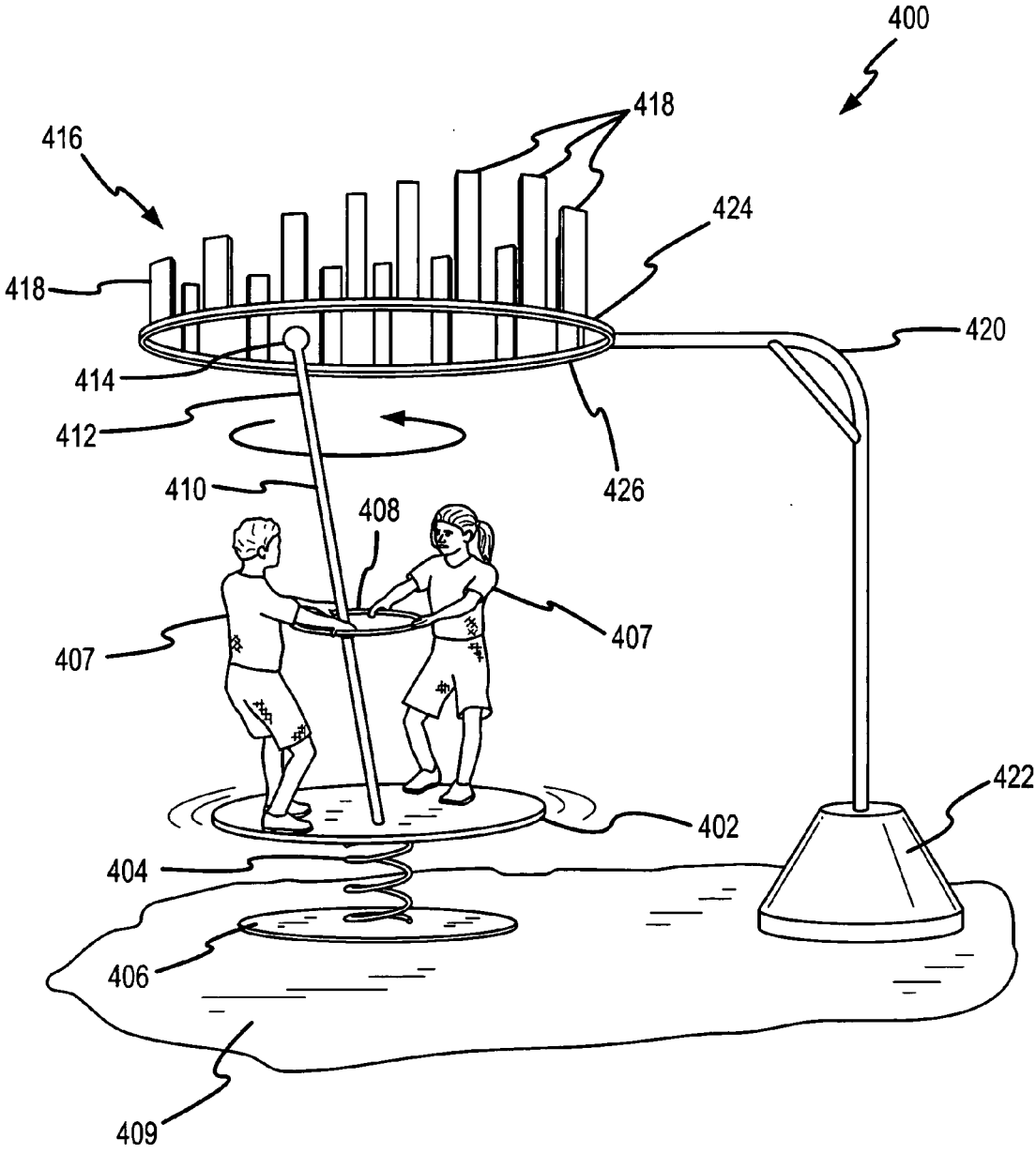
FIG. 7 is a side view of yet another embodiment of the invention.

As depicted in FIG. 7, yet another embodiment 400, includes a platform 402 supported by a spring 404 that is in turn connected to a support member 406. The spring 404 supports the platform 402 above the support member 406, and one or more users (two users 407 are depicted in FIG. 7) stands on the platform 402 and holds a handle 408 attached to a pole 410 that is anchored in the center of the platform 402 and extends above the platform 402. The support member 406 is connected to a support surface 409 such as the ground or a deck platform. The top end 412 of the pole 410 includes a mallet-like element 414. The spring 404 is flexible and the users can tilt the platform 402 and thereby move the pole 410 by leaning backwards or forwards or sideways, in linear and/or circular movements, while holding the handle 408. A marimba-like structure 416 including a sequence of tines 418 of varying lengths is suspended or supported by a support arm 420 over the platform 402, the support arm 420 anchored, as depicted in FIG. 7, in the second support member 422 or, alternatively, in the support member 406. The tines 418 constitute struck members, which, when contacted by the mallet-like element 414, the striking member, produce a sound. The tines 418 are anchored in a hoop 424 connected to the support arm 420. In this embodiment, the tines 418 are solid metal bars, although other embodiments can be envisioned where the tines 418 are replaced by hollow, open-ended tubes, and further embodiments can be envisioned where the tines can be formed of other materials such as wood, bamboo, horn, plastic, and ceramic material, and shaped in other ways, such as thin metal filaments or strings, bells, or chimes. The hoop 424 can include a resonator 426 mounted beneath the tines 418 to intensify, direct and/or amplify the sound. The resonator 426 can be any of several structures as will be appreciated by those familiar with the field, such as an open bell-like structure, or a tube open at one or both ends. An amplifying tube or bell can be substituted for the resonator 426. As the platform 402 is tilted by one or more users, the mallet-like element 414 is also moved and the user can direct its movement, such that the mallet-like element 414 strikes one or more of the tines 418. The user can manipulate the platform 402 such that the mallet-like element 414 strikes selected tines 418, or a succession of tines 418. The tines 418 can be of the same length or of varying lengths and can be arranged to produce the sound of a musical scale or other arrangement of tones, when struck in succession. As the user manipulates the platform 402 and pole 410, such that the mallet-like element 414 strikes selected tines 418, a musical sound, tune or melody can be produced.

Figure 8:
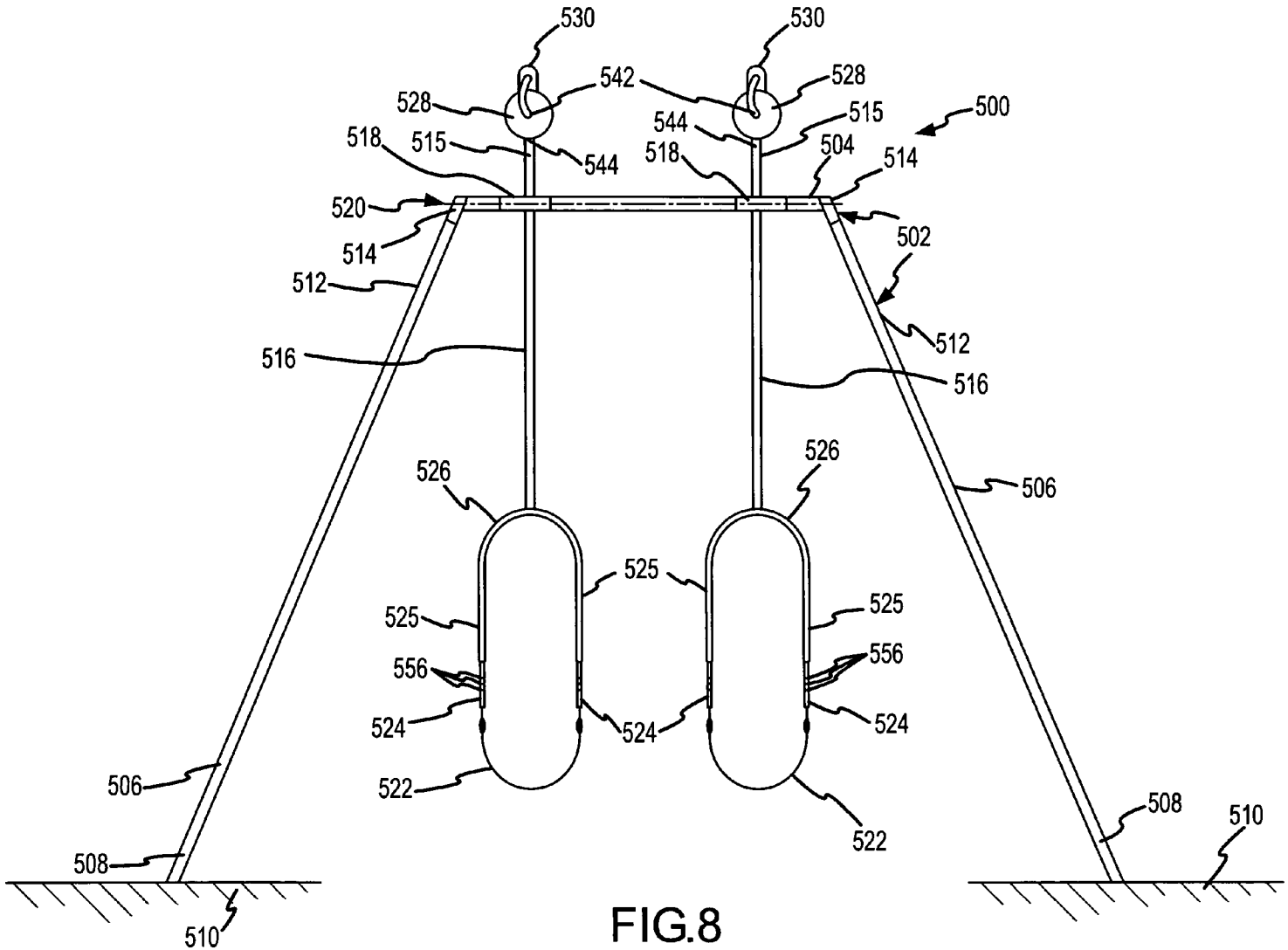
FIG. 8 is a front view of an alternate embodiment of the invention.
Figure 9:
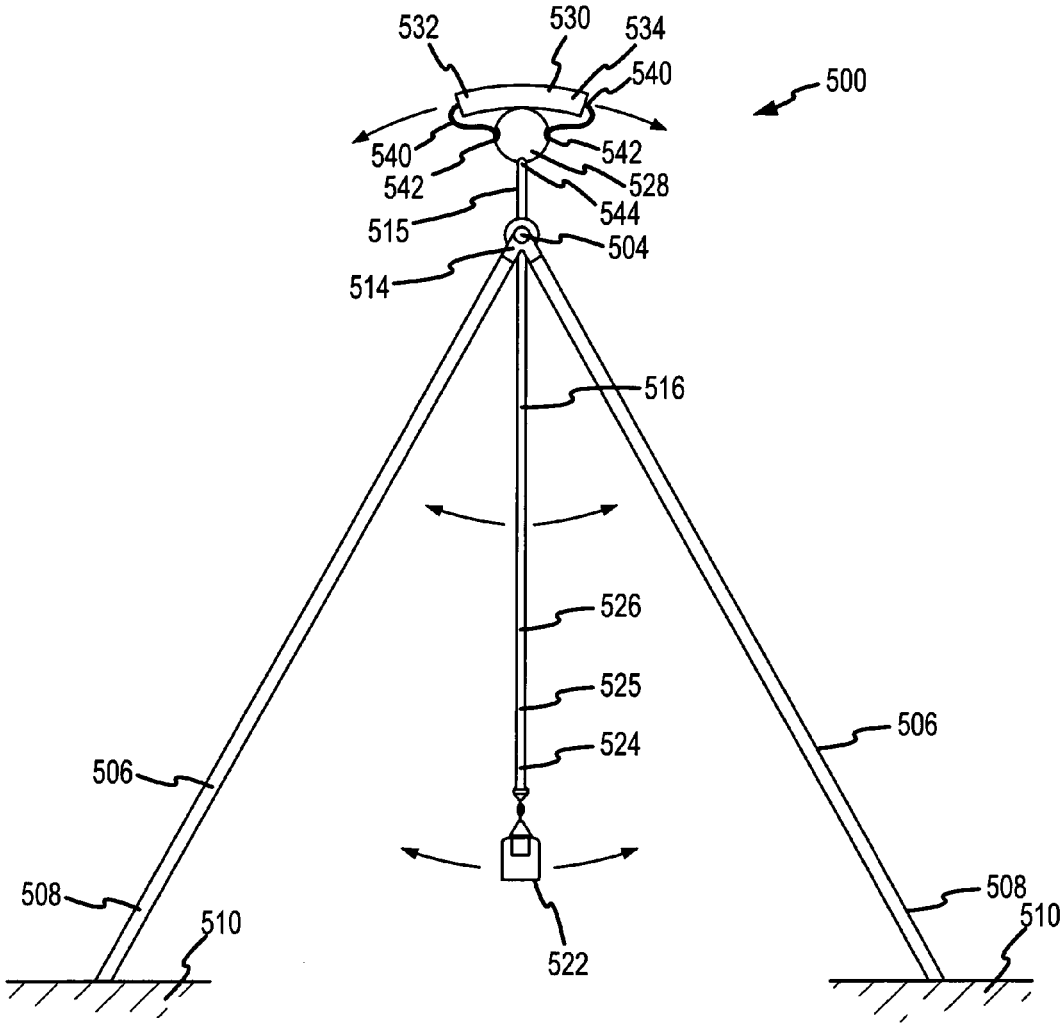
FIG. 9 is a side view of the embodiment of FIG. 8.

In a further embodiment 500 depicted in FIG. 8, which involves a swing structure, the support member of the apparatus includes a frame 502 with a cross-bar 504 and two or more legs 506, each leg 506 anchored at its bottom end 508 in a support surface 510 and connected at its top end 512 in a joint member 514 to support the cross bar 504. In this embodiment, the moveable member is a swing mechanism, including a tube 516 connected by a swing pivot, in this embodiment the swing pivot being a bearing element 518, to the support member at the cross bar 504, and the tube 516 pivoting at the bearing element 518 around the axis 520 that runs lengthwise along the center of the cross bar 504. The swing mechanism also includes a swing seat 522, such as a flexible seat made of fabric, plastic, or other material, or a flat seat or bucket seat, that supports the user. The seat 522 is connected to hollow handle pieces 524 that are then connected to hollow arm pieces 525 and then to a hollow U-shaped tube 526 that is connected to the tube 516. A passageway in the interior of the tubing, including the tube 516, U-shaped tube 526, arm pieces 525 and handle pieces 524, permits the flow of air from the top end 515 of the tube 516 to the handle pieces 524. The swing structure further includes a sound producing mechanism that is an air operated sound generator configured to produce sound as air passes therethrough. The movement of the swing mechanism from at least a first position to a second position provides the energy for the generation of an air flow that in turn is utilized by the sound generator to produce sound. The air operated sound generator includes an air reservoir 528 and an air compressor 530, mounted on the top end 515 of the tube 516, above the bearing element 518 and cross bar 504. As depicted in FIGS. 8 and 9, the air compressor 530 is a hollow, closed cylindrical tube, with a slight curvature, mounted on the tube 516 perpendicular to the cross bar 504, curving downward at its front end 532 and back end 534. Within the air compressor 530, a piston is positioned (not shown), which fills the diameter of the air compressor 530, and moves from one end 532 of the compressor 530 to the other end 534 with the force of gravity, as the air compressor 530 is moved back and forth when the rod 516 moves pivotally at the bearing element 518. As the piston moves toward the front end 532, the piston forces air out of the air compressor 530 and through one of the two connector tubes 540 (in this case, flexible plastic tubes) connected at each end 532,534 of the air compressor 530, and into the air reservoir 528 through one of the two valve elements 542 located at the point where the connector tubes 540 are connected to the air reservoir 528. Alternate air compressor mechanisms can be substituted as will be appreciated, such as a rod and piston or pump arrangement positioned either above the cross bar 504 or below it, driven by the movement of the swing mechanism.

Figure 10:
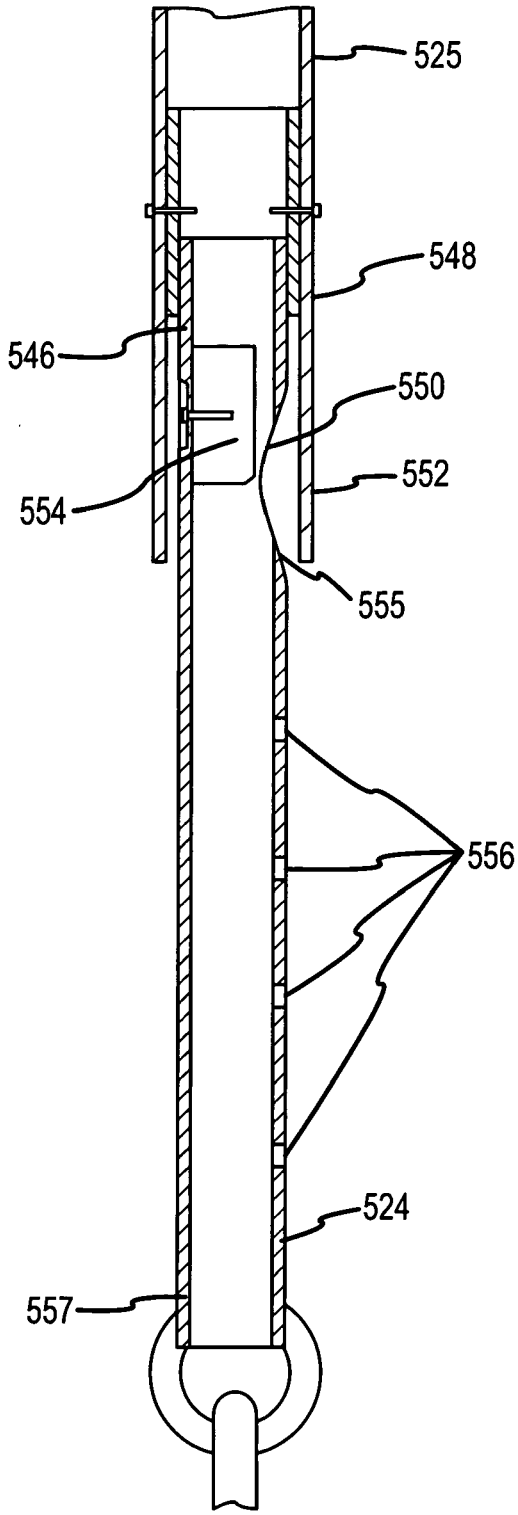
FIG. 10 is a side cross-sectional view of a portion of the sound-producing mechanism of the embodiment of FIG. 8.

The valve elements 542 permit air to enter the air reservoir 528 freely, but to flow only minimally in the opposite direction. The air reservoir 528 includes an interior bladder (not shown) and second valve mechanism 544 that control the flow of air from the air reservoir 542 into the top end 515 of the tube 516. In a preferred embodiment, the bladder and valve mechanism 544 control the flow of air into the tube 516 such that a substantially constant flow of air is released into the tube 516 once a selected pressure is reached within the air reservoir 530. As air is released from the air reservoir 528 into the tube 516, it flows down to the U-shaped tube 526 and then flows into one or both of the arm pieces 525, and then into one or both of the handle pieces 524. As depicted in FIG. 10, the top end 546 of each of the handle pieces 524 is inserted into and connected to the bottom end 548 of each of the arm pieces 525, and an aperture 550 is positioned in the top end 546 of each handle piece 524, which is covered by the lower wall 552 of the arm piece 525. A languid (also called a languet) 554, such as may be found in pipe organs, is positioned in each handle piece 524, over which air flowing down through the handle pieces 524 passes. The languid 554 blocks and narrows the flow of air into a thin sheet of air that then passes across the aperture 550 proximate the languid 554, and against the lip 555 of the aperture 550, setting up a vibration in the air within the handle pieces 524 that produces sound. In one alternative embodiment, one or more reed elements can be positioned in the handle pieces 524, or at another location in the sound producing mechanism, to produce a vibration and sound as air passes across the reed or reeds. As will be appreciated, the handle pieces 524 can include one or more apertures 556 as are found in flutes or recorders, which can be covered by the fingers of the user to vary the pitch of the sound produced as air passes through the handle pieces 524. In one configuration, by covering the apertures 556 in a selected way, the user can thereby play a tune or a scale, or a pleasant series of tones, and so produce music as the user swings. The configuration of the sound generating structure can be varied utilizing apertures, reed elements, languids, or other structural elements to produce sound like that generated by any of various musical instruments such as a flute, recorder, clarinet, organ, pennywhistle, harmonica, or accordion.

When a user operates the swing structure of FIGS. 8, 9 and 10, the user is seated in the swing seat 522, and by pushing off from the ground and/or by extending and folding the user's legs, the user causes the swing seat 522 and the tube 516 to move pivotally at the bearing element 518 of the cross arm 504 from at least a first position to a second position. This movement, in turn, causes the air compressor 530 to pump air into the air reservoir 528, the air in turn flowing from the air compressor 530 down the interior passageway of the tube 516, the U-shaped tube 526, arm pieces 525 and handle pieces 524, to produce sound as the air is directed across the languid 554, aperture 550 and lip 555, of each handle piece 525, and exits the handle piece 524. It should be noted that the handle pieces 524 can be open or closed at their bottom end 557. As will be appreciated, the user's swinging motion causes the sound producing mechanism to produce sound, thus providing an enhanced experience.

Other devices for directing the flow of air and the nature of sound produced can be utilized in this embodiment. Structures similar to other wind instruments can be substituted. In one variation of this configuration, such as in organ-like instruments, there are several sound tubes with varying lengths and with sound apertures of varying size, and as released air is directed through selected but differently sized tubes, or multiple tubes at the same time, sounds of varying pitch are produced. In one configuration, a harmony is produced. Also, other sound producing mechanisms can be substituted for a mechanism utilizing a flow of air to produce sound, such as a rain stick mechanism as shown in FIG. 1 above, or bells, chimes, or marimba type bars, which can be struck, or otherwise activated to produce sound, with the energy produced by the movement of a user's swing seat 522 and tube 516 from one position to another.

Figure 11:
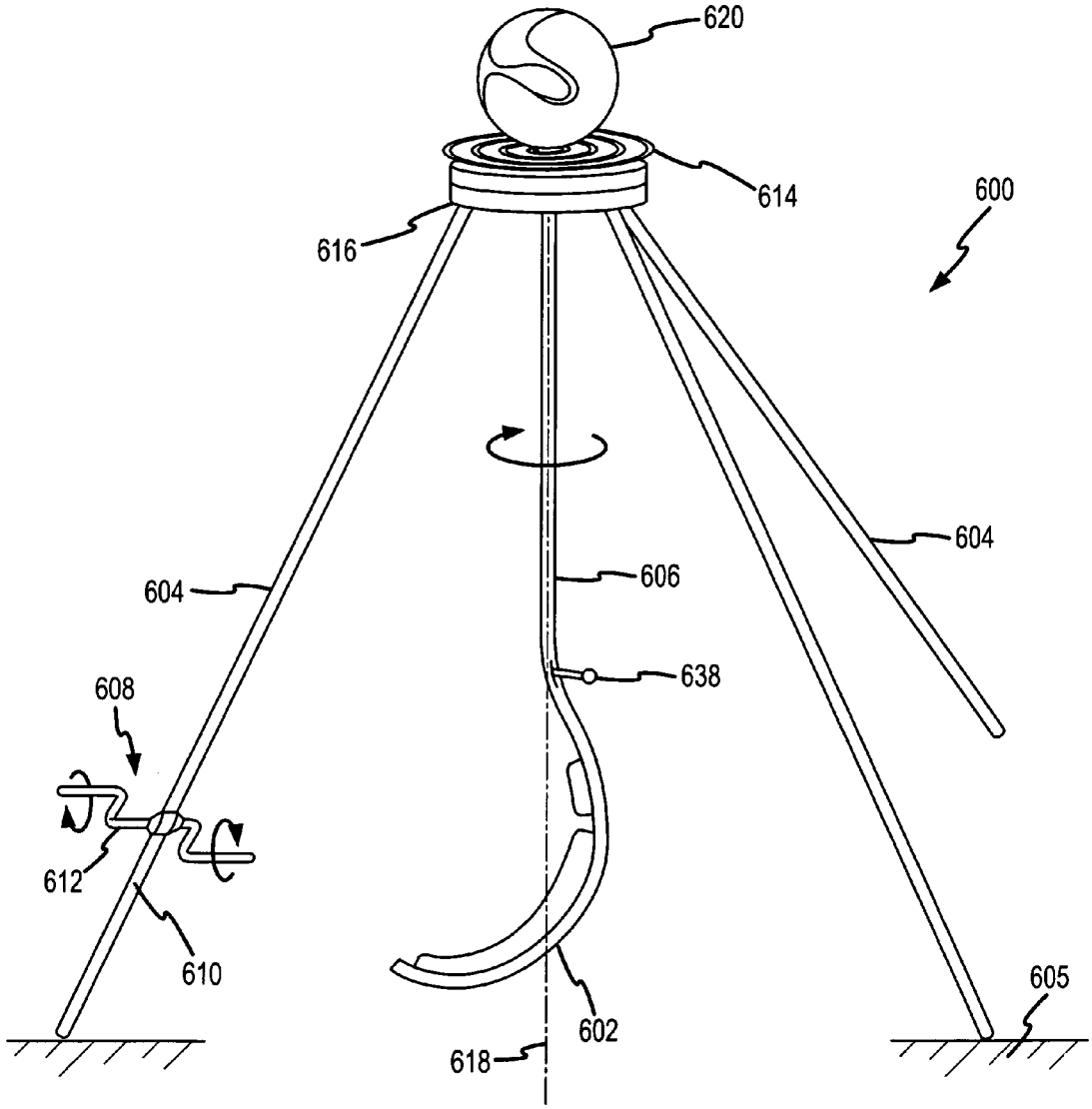
FIG. 11 is a side view of another embodiment of the invention.

As depicted in FIG. 11, in yet another embodiment 600, the apparatus includes a moveable seat structure 602, that is suspended from a support frame 604 positioned on a support surface 605, the seat structure 602 suspended by an elongated rod 606. The moveable member is a crank mechanism positioned in one leg 610 of the support frame 604, for storing energy applied by the user. When the crank handle 612 is turned by a user, the crank handle 612 turns a gear mechanism (not shown), such as a worm gear or an angle gear, and rod (not shown) contained in the leg 610 above the crank handle 612, such that the rod in turn spins, and through another gear mechanism (not shown) at the top of the rod causes a concentric spring mechanism 614 to be wound. The rod runs the length of the leg 610 extending from the crank handle 612 to the top 616 of the support frame 604. The spring mechanism 614 is positioned at the top 616 of the support frame 604, and the energy of the user stored in the spring mechanism 614, on release, is transferred to the rod 606, causing it to rotate or spin the seat structure 602 around an axis 618 running vertically from the support surface 605 upwards to the top 616 of the support frame 604. The crank mechanism and spring mechanism 614 are both also connected to a sound producing mechanism 620, and as the spring mechanism 614 is wound and stores energy, and when it unwinds and releases energy, the movement of the spring mechanism 614 in turn urges elements of the sound producing mechanism 620 to produce sound.

Figure 12:
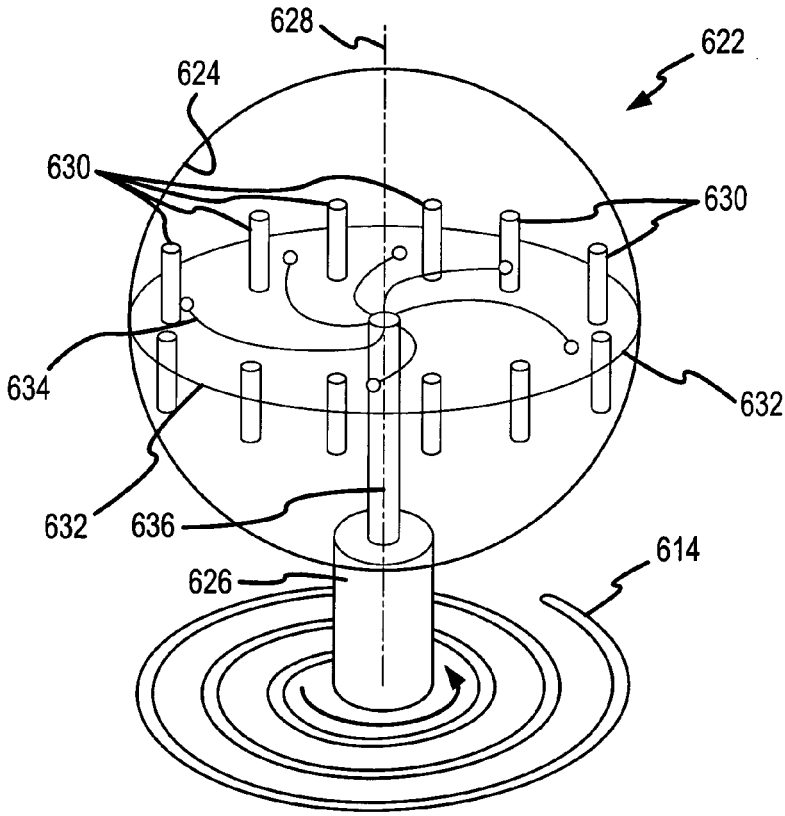
FIG. 12 is a side internal view of the chime ball mechanism of FIG. 11.
Figure 13:
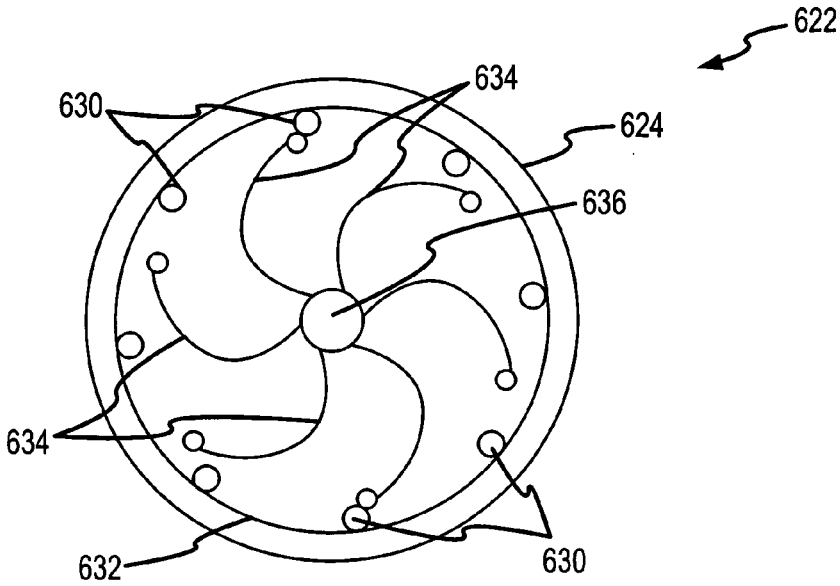
FIG. 13 is a top view of the chime ball mechanism of FIG. 11.

In this embodiment, the sound producing mechanism 620 is a chime ball 622. Other sound producing devices can be substituted for a chime ball, such as a marimba-like structure, a bell or gong, or a pipe that involves the passage of air through or across an aperture or reed to produce sound. The internal workings of the chime ball 622 of the present embodiment are depicted in FIGS. 12 and 13. FIG. 12 is a side internal view of the chime ball 622. The chime ball 622 includes a hollow sphere 624 connected to a tube 626. The sphere 624 is formed from metal although other materials can be used. The tube 626 is connected to the concentric spring mechanism 614, and the tube 626 rotates as the spring mechanism 614 is wound or released. In turn, when the tube 626 rotates, the hollow sphere 624 also rotates around an axis 628 (it will be noted that this axis is essentially the same as the axis 618 of FIG. 11). The chime ball 622 includes a plurality of chimes 630 mounted on a ring support 632 connected to the interior surface of the sphere 624. The chime ball 622 also includes a plurality of mallets 634 attached to a stationary rod 636 connected at one end to the top 616 of the support frame 604. As the sphere 624 and chimes 630 rotate, the chimes 630 strike the mallets 634, to produce sound. Other chime ball, or music box-like, structures can be contemplated, and the present description is not intended to limit the invention to structure depicted. FIG. 13 depicts a top cross-sectional view of the chime ball 622, showing the hollow sphere 624, ring support 632, chimes 630, mallets 634, and rod 636. Referring again to FIG. 11, it will be noted that the rod 606 includes a brake handle 638, which, when grasped and pulled by the user, releases a brake mechanism (not shown) connected to the concentric spring 614, to allow the spring 614 to unwind and spin the seat structure 602 and the chime ball 622, producing a spinning motion in the seat structure 602 and a chime sound coming from above in the chime ball 622. When the user releases the brake handle 638, the brake mechanism returns to its default position and stops the spinning motion in the seat structure 602 and rod 606, and the sound from the chime ball 622 also ends.

As will be appreciated by those familiar with the field, various other applications and embodiments of the structure described above are possible and the spirit and scope of the appended claims should not be limited to the versions contained herein.

What is claimed is:

1. An apparatus comprising:

a support member configured for support by one of a support surface and a support structure;

a moveable member connected to said support member to be movable relative to said support member between a first position and a second position;

a user support mechanically associated with said moveable member, said user support being configured to support at least one user positioned thereon, said user support being configured and positioned on said moveable member for the user to apply a selected force to one of said moveable member, said support surface, said support structure and said support member to urge said moveable member between said first position and said second position; and a sound producing mechanism connected to one of said user support, said support member, and said moveable member to produce sound as said moveable member moves between said first position and said second position, wherein said sound producing mechanism includes a struck member means configured to generate sound upon being struck, and a striking member means associated with said moveable member and positioned to strike said struck member means upon movement of said moveable member between said first position and said second position.

2. The apparatus of claim 1, wherein said sound producing mechanism is configured to generate a first number of sounds upon application by the user of a first selected force and a second selected force to one of said moveable member, said support surface, said support structure, and said support member.

3. The apparatus of claim 1 wherein said sound producing mechanism includes at least one surface for movement of said striking member means thereon, and wherein said struck member means is positioned to be struck by said striking member means moving on said at least one surface as said moveable member moves between said first position and said second position.

4. The apparatus of claim 1 wherein said struck member means includes a plurality of struck members each selected to produce a sound of a preselected frequency, and wherein said user, applying a first selected force, causes said striking member means to strike a first number of said struck members generating a plurality of sounds of preselected frequency.

5. The apparatus of claim 4 wherein said plurality of struck members produce said plurality of sounds in one of a harmony and a melody.

6. The apparatus of claim 1, wherein said moveable member is a see-saw beam having a first end and a second end spaced apart from said first end, said see-saw beam being positioned on said support member at a pivot point between said first end and said second end, and wherein said user support includes a first user seat proximate the first end of said see-saw beam for a first user and a second user seat proximate the second end of said see-saw beam for a second user, said first user seat and said second user seat each being positioned on said see-saw beam for said first user and said second user to each selectively apply a force to said support surface to urge said see-saw beam in pivoting movement around said pivot point between said first position and said second position.

7. The apparatus of claim 6, wherein said see-saw beam has a selected length and wherein said struck member means is an elongated closed container, said elongated closed container being connected to said see-saw beam to extend along a portion of said length, said container forming at least one interior chamber, wherein said striking member means is a plurality of moveable objects at least a portion of which change position within said container and make an audible sound when said see-saw beam is moved in a pivoting movement by said first user and second user.

8. The apparatus of claim 7, wherein said moveable objects are spherical in shape.

9. The apparatus of claim 7, wherein said moveable objects are marbles.

10. The apparatus of claim 7, wherein said moveable objects are plastic balls.

11. The apparatus of claim 7, wherein said moveable objects are metal pellets.

12. The apparatus of claim 7, said struck member means further including a plurality of projecting elements, each projecting element having a first end and a second end, and each of said projecting elements being attached at said first end to said container to extend to said second end in the interior of said container, said projecting elements each being sized and positioned to be contacted by at least one of said moveable objects and to thereupon generate an audible sound.

13. The apparatus of claim 12 wherein said projecting elements are positioned in a selected configuration and sized to generate audible sounds selected to produce a desired frequency pattern.

14. The apparatus of claim 7, wherein at least a portion of the walls of said container is formed of a transparent material oriented for a user to view at least one moveable object as it moves within said chamber.

15. The apparatus of claim 6, further comprising a damping means for damping the pivoting movement of said see-saw beam.

16. The apparatus of claim 15, wherein said damping means includes an extension spring connected at one end to said see-saw beam and at a second end to said support member, said extension spring being positioned and sized to restrict the pivoting movement of said see-saw beam.

17. The apparatus of claim 16, wherein said damping means includes a shock absorber connected at one end to said see-saw beam and at a second end to said support member, and wherein said shock absorber resists the pivoting movement of said see-saw beam.

18. The apparatus of claim 1, wherein said striking member means is at least one moveable object positioned to contact said struck member means to cause sound to be generated as said moveable member moves in response to force applied by said user.

19. The apparatus of claim 18 wherein said struck member means is a sound board.

20. The apparatus of claim 18 wherein said sound producing mechanism includes a rain stick.

21. The apparatus of claim 18 wherein said sound producing mechanism includes a bell.

22. The apparatus of claim 20 wherein said sound producing mechanism includes a container that includes at least one wall that forms at least one chamber and wherein said at least one movable object is positioned within and moveable within said chamber and generates sound as it moves within said chamber.

23. The apparatus of claim 22 wherein said chamber has at least one surface upon which said moveable object moves.

24. The apparatus of claim 23 wherein said at least one surface has a plurality of projecting elements attached to said at least one surface configured to vibrate and generate audible sound when struck by said moveable object, each of said projecting elements being positioned to be contacted by said moveable object as it moves.

25. The apparatus of claim 24 wherein said striking member means is a plurality of movable objects.

26. The apparatus of claim 25, wherein said projecting elements are positioned in a selected configuration and sized to generate audible sounds selected to produce a selected frequency pattern.

27. The apparatus of claim 25 wherein said projecting elements are in a selected configuration and sized to generate at least a portion of a known melody.

28. The apparatus of claim 25, wherein said sound generating mechanism includes a resonator, which amplifies the sound produced when said projecting elements are contacted by said moveable objects.

29. The apparatus of claim 24, wherein said projecting elements are solid metal bars.

30. The apparatus of claim 24, wherein said projecting elements are hollow tubes.

31. The apparatus of claim 24, wherein said projecting elements include bells.

* * * * *